US006697026B1

(12) United States Patent
Hemmingsen, II

(10) Patent No.: US 6,697,026 B1
(45) Date of Patent: Feb. 24, 2004

(54) SATELLITE ANTENNA ALIGNMENT DEVICE

(76) Inventor: Robert J. Hemmingsen, II, 500 Wendy Heights Rd., Council Bluffs, IA (US) 51503

( * ) Notice: Subject to any disclaimer, the term of this patent is extended or adjusted under 35 U.S.C. 154(b) by 51 days.

(21) Appl. No.: 10/094,668

(22) Filed: Mar. 11, 2002

Related U.S. Application Data

(63) Continuation-in-part of application No. 09/668,596, filed on Sep. 22, 2000, now Pat. No. 6,366,253.

(51) Int. Cl.[7] ..... H01Q 3/00
(52) U.S. Cl. ..... 343/760; 343/882; 343/894
(58) Field of Search ..... 343/760, 894, 343/882

(56) References Cited

U.S. PATENT DOCUMENTS

| | | | |
|---|---|---|---|
| 2,064,236 | A | 12/1936 | Willis |
| 2,085,059 | A | 6/1937 | Woodside |
| 2,698,902 | A | 1/1955 | Farrow, Jr. et al. |
| 2,926,842 | A | 3/1960 | Ackerman |
| 3,816,000 | A | 6/1974 | Fiedler |
| 4,095,342 | A | 6/1978 | Oertli |
| 4,175,330 | A | 11/1979 | Hermann |
| 4,422,738 | A | 12/1983 | Steele |
| 4,754,947 | A | 7/1988 | Propp |
| 4,771,548 | A | 9/1988 | Donnery |
| 4,866,852 | A | 9/1989 | Plier |
| 5,007,320 | A | 4/1991 | Craig et al. |
| 5,103,569 | A | 4/1992 | Leatherwood |
| 5,734,356 | A | 3/1998 | Chang |
| 5,977,922 | A | 11/1999 | Hemmingsen, II |
| 6,081,240 | A | 6/2000 | Hemmingsen, II |
| 6,160,520 | A | 12/2000 | Muhlhauser et al. |
| 6,366,253 | B1 * | 4/2002 | Hemmingsen, II et al. . 343/760 |

OTHER PUBLICATIONS

Parts Express Catalog "Satellite Finder Kit", p. 13.
MCM Electronics Catalog 35 "Satellite Finder Kit", p. 246.
DBL Distributing, Inc. Catalog "Monster Cable Digital Satellite Finder", p. 10.
Petra Catalog "Perfect 10 Satellite Finder", p. 7, and "Monster Cable Monster Satellite Digital Satellite Finder", p. 10.

* cited by examiner

*Primary Examiner*—Michael C. Wimer

(57) ABSTRACT

A satellite antenna alignment device is provided which includes a base plate having a semi-globular-shaped member of dome secured thereto and extending upwardly therefrom which defines a sealed compartment which is filled with a liquid or gaseous medium. An indicator is positioned within the sealed compartment. The exterior surface of the dome is provided with elevational and skew angle indicia thereon. The device enables the antenna to be quickly and easily elevated to the proper elevation and skewed to the proper skew angle.

23 Claims, 5 Drawing Sheets

SATELLITE ANTENNA ALIGNMENT DEVICE

CROSS-REFERENCE TO RELATED APPLICATIONS

This application is a continuation-in-part of Ser. No. 09/668,596 filed Sep. 22, 2000 now U.S. Pat. No. 6,366,253 B1.

BACKGROUND OF THE INVENTION

1. Field of the Invention

This invention relates to a satellite antenna alignment device and more particularly to an alignment device which enables a satellite antenna to be aligned with respect to at least a pair of satellites, and perhaps more, to enable the satellite antenna to properly receive the signals from the satellites.

2. Description of the Related Art

Satellite antennas are frequently used by owners of television sets to receive the signals from a particular satellite. Satellite antennas have more recently been used by internet providers as well. In recent years, the small satellite antennas have become increasingly popular. Many different companies provide satellite television services such as DISH Network™, PRIMESTAR™, DIRECT TV™, etc. In most cases, each of the companies utilizes a particular satellite to transmit signals to their customers. In order for the satellite antennas to receive the signals from the satellite, it is necessary that the antenna be properly aligned with respect to the associated satellite. Generally, the satellite antennas have a low noise block amplifier with integrated feed (LNBF) mounted on the end of a support arm so that the antenna dish will collect and focus the satellite signal onto the LNBF. Frequently, the manufacturer of satellite antennas will provide alignment information to the installers with that information being related to particular zip codes. For example, if a satellite antenna is going to be used with the DISH Network™ and is going to be used in zip code 68118, the manufacturer will advise the installer that the dish of the antenna must be directed or aimed along compass heading or azimuth 207° and must be elevated upwardly from the horizontal 37°.

Electronic devices have been provided for use in aligning satellite antennas which measure the strength of the satellite signals. However, it is necessary for the antenna to be generally aligned with the satellite before those electronic devices will function properly. The alignment of the satellite antennas frequently requires that at least two people be involved and the same is costly and time-consuming. In most satellite antennas, when viewed from the top or bottom thereof, i.e., a vertical plane, the LNBF support arm extends transversely from the dish. Thus, if the dish is aligned or aimed along a particular compass heading, the LNBF support arm will also extend along that same compass heading, but will not point directly at the satellite, since it does not extend from the dish at a right angle when viewed from the side. Normally, when viewed from the side, the plane of the dish and the LNBF support arm form an acute angle. In other words, the dish may be elevated 37° from the horizon but the support arm may be elevated 44° or so, depending upon the particular antenna.

In some cases, the installer attempts to manually align the antenna along the proper compass heading by holding a compass some distance below or above the support arm and then attempts to align the support arm along the proper compass heading. This procedure is crude, at best, and the metal construction of the support arm frequently interferes with the normal operation of the compass. Further, it is extremely difficult for the installer to elevate the dish to the proper elevation, after being directed along the proper azimuth, so that the antenna will be properly aligned.

In an effort to solve the problems of the prior art enumerated above, applicant previously invented a satellite antenna alignment device which is the subject of U.S. Pat. Nos. 6,081,240 and 5,977,922. Although the device of the previously identified patents works extremely well when the antenna is being aligned with a single satellite, certain satellite antennas are now designed to receive signals from the satellites positioned at 110° west longitude and 119° west longitude. In those antennas designed to receive signals from two satellites, the antenna must have a pair of low noise block amplifiers with integrated feed (LNBF) which are mounted on the end of an elongated support arm. The inner end of the elongated support arm is normally secured to a dish mounting bracket which is selectively movably mounted on a skew scale. The skew scale is mounted on a mast clamp which is secured to the upper end of a mast clamp. The mast clamp may be pivotally moved with respect to the mast to change the elevation of the antenna. The skew plate and dish mounting bracket may be rotated with respect to the mast so that the azimuth (direction) of the antenna may be changed. Further, the dish mounting bracket may be rotatably moved with respect to the skew plate to rotate the dish or antenna. Although the conventional satellite antennas which are used to receive signals from a pair of satellites include elevation and skew scales provided thereon, those scales are not completely accurate. Further, for the elevation and skew angles to be accurate, the upper end of the mast must be perfectly plumbed in a vertical condition. If the upper end of the mast is not perfectly plumb, the elevation and skew angles scales will be dramatically inaccurate. In the co-pending application, an alignment device is disclosed which solves the above-enumerated problems. The invention disclosed herein represents an improvement over the invention of the co-pending application.

BRIEF SUMMARY OF THE INVENTION

An alignment device is provided for a satellite antenna which is adapted to receive signals from at least two or more satellites. The antenna includes a mast assembly, a support arm extending outwardly and upwardly from the mast assembly with a pair of LNBFs mounted on the outer end thereof, and a dish operatively secured to the support arm for movement therewith. The antenna alignment device of this invention is operatively removably secured to the amplifier support arm and includes a base plate having a transparent, hollow, semi-globular shaped member or dome positioned thereon which defines a sealed compartment filled with a gas or liquid medium. The semi-globular shaped member or dome has indicia thereon which indicates elevation and skew angles.

A single, movable indicator is positioned in the sealed compartment for indicating the elevation and skew of the dish. In one embodiment of the invention, the indicator is an air bubble. In another embodiment, the indicator is a float member. In yet another embodiment, the indicator comprises an indicator needle which extends upwardly from a floating plate. In all of the embodiments, the indicator moves with respect to the semi-globular shaped member or dome, and the indicia thereon, as the dish and support arm are moved relative to the mast assembly to indicate the elevation and skew angles of the dish.

It is therefore a principal object of the invention to provide an improved satellite antenna alignment device.

A further object of the invention is to provide a satellite antenna alignment device which may be used with satellite antennas which receive signals from at least two satellites.

Still another object of the invention is to provide a satellite antenna alignment device which enables the satellite antenna to not only be accurately elevated, but also accurately skewed.

These and other objects will be apparent to those skilled in the art.

DETAILED DESCRIPTION OF THE INVENTION

Figure 2:
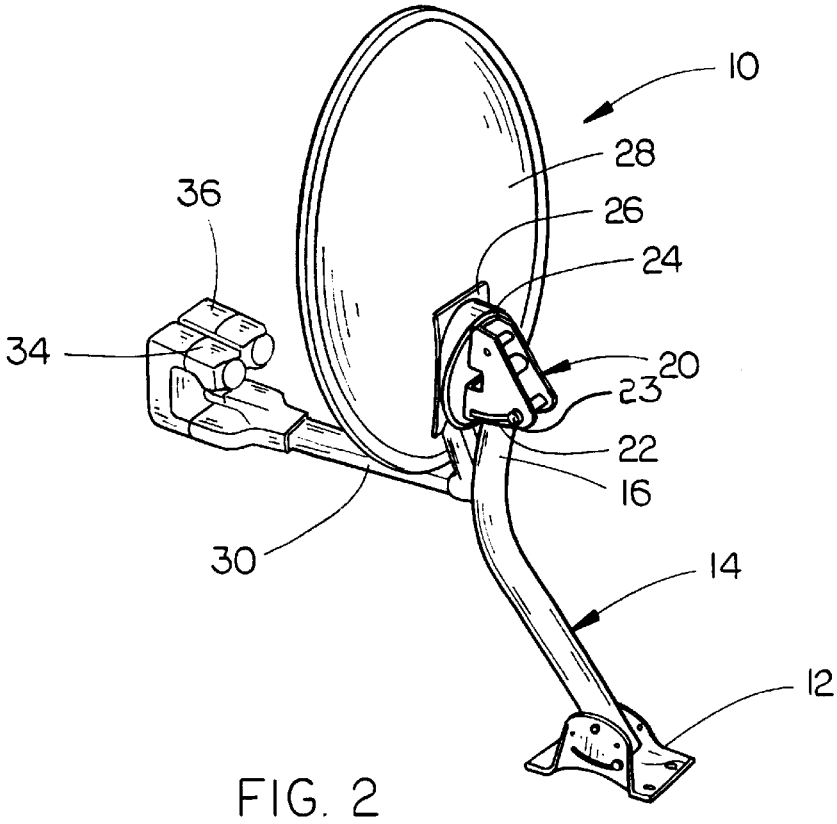
FIG. 2 is a perspective view of a satellite antenna.
Figure 3:
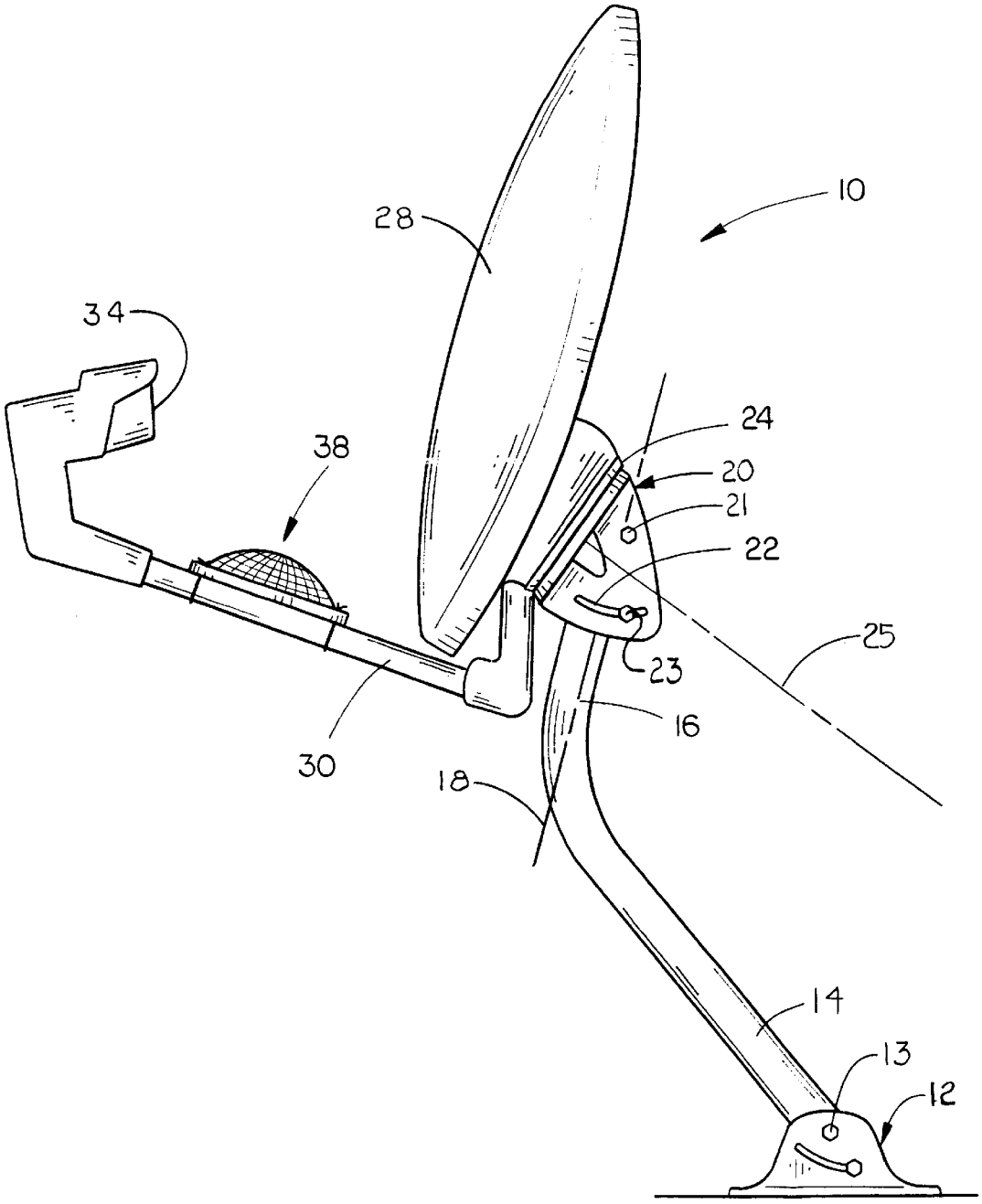
FIG. 3 is a side view of a satellite antenna.

The numeral 10 refers to a conventional satellite antenna such as a Dish Network™ 500 antenna. The antenna 10 includes a mounting bracket 12 having a mast 14 pivotally secured thereto and which extends therefrom for pivotal movement about a horizontal axis 13. The upper end of the mast 14 normally includes a top portion 16 which must normally be disposed as close to vertical as possible. A conventional mast clamp (not shown) is clamped onto the top portion 16 of the mast 14. A dish mounting bracket 20 is pivotally secured to the mast clamp for pivotal movement about top portion 16 along an azimuth axis 18 (FIG. 3). Bracket 20 is also pivotal about a horizontal elevation axis 21. Adjustment slot 22 and adjustment nut 23 permit adjustment of the elevation angle about elevation axis 21. An elevation scale (not shown) permits setting of the elevation angle about elevation axis 21. A skew member 24 is rotatably secured to the mounting bracket 20 for pivotal movement about a skew axis 25. Skew member 24 includes a conventional skew scale (not shown). Bracket member 26 (FIG. 2) is secured to skew member 24 for movement therewith. Dish 28 is secured to the bracket member 26 by bolts or the like.

A support arm 30 is operatively secured to the bracket member 26 and extends outwardly from the dish 28, as seen in the drawings. At least a pair of LNBFs 34 and 36 are mounted A on the outer end of the support arm 30. In some cases, additional LNBFs may be used if the antenna will be receiving signals from more than two satellites.

In prior methods, in order for the antenna 10 to receive signals from two satellites, such as those orbiting at 100° and 190° west longitude, the mounting bracket 12 was secured to a suitable attachment surface with the top portion 16 of the mast 14 being perfectly vertical.

Prior methods for installation involve the initial step of setting the skew of the antenna by rotating the dish mounting bracket 20 about the skew axis 25 to align the skew point (not shown) with the required angle on a skew scale (not shown). The elevation of the antenna is then set by tilting the dish mounting bracket 20 about elevation axis 21 to align the required angle on the elevation scale. The dish is then secured to the mounting bracket and the mounting bracket is mounted on the mast 14 by means of the mast clamp.

The installer then normally attempts to position the antenna along the correct azimuth by pivoting the antenna about azimuth axis 18. If the upper portion 16 of the mast is not perfectly vertically disposed (as is shown in FIG. 3), the antenna will be improperly aligned. Further, if there is any discrepancy in the elevation adjustment and the skew adjustment, the antenna will not be in alignment. Normally, the signal strength of devices are used to fine-tune the alignment of the antenna.

The antenna 10 disclosed herein is skewed to enable the antenna to receive signals from two or more satellites. It is for that reason that the invention described herein has been provided.

Figure 1:
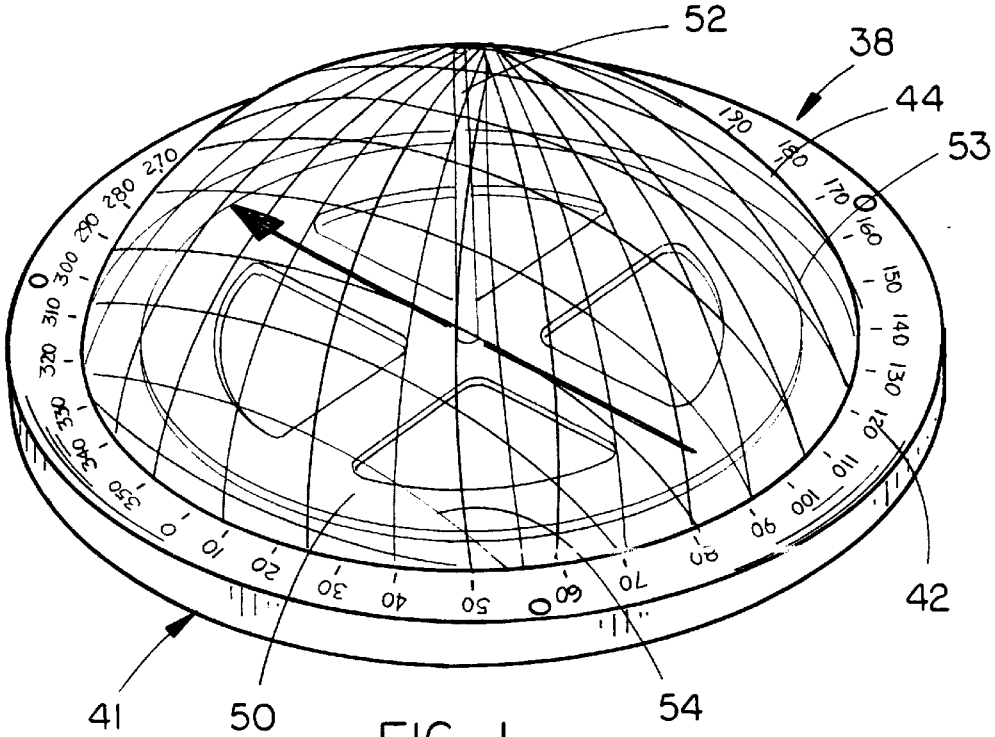
FIG. 1 is a perspective view of the satellite antenna alignment device of this invention.
Figure 4:
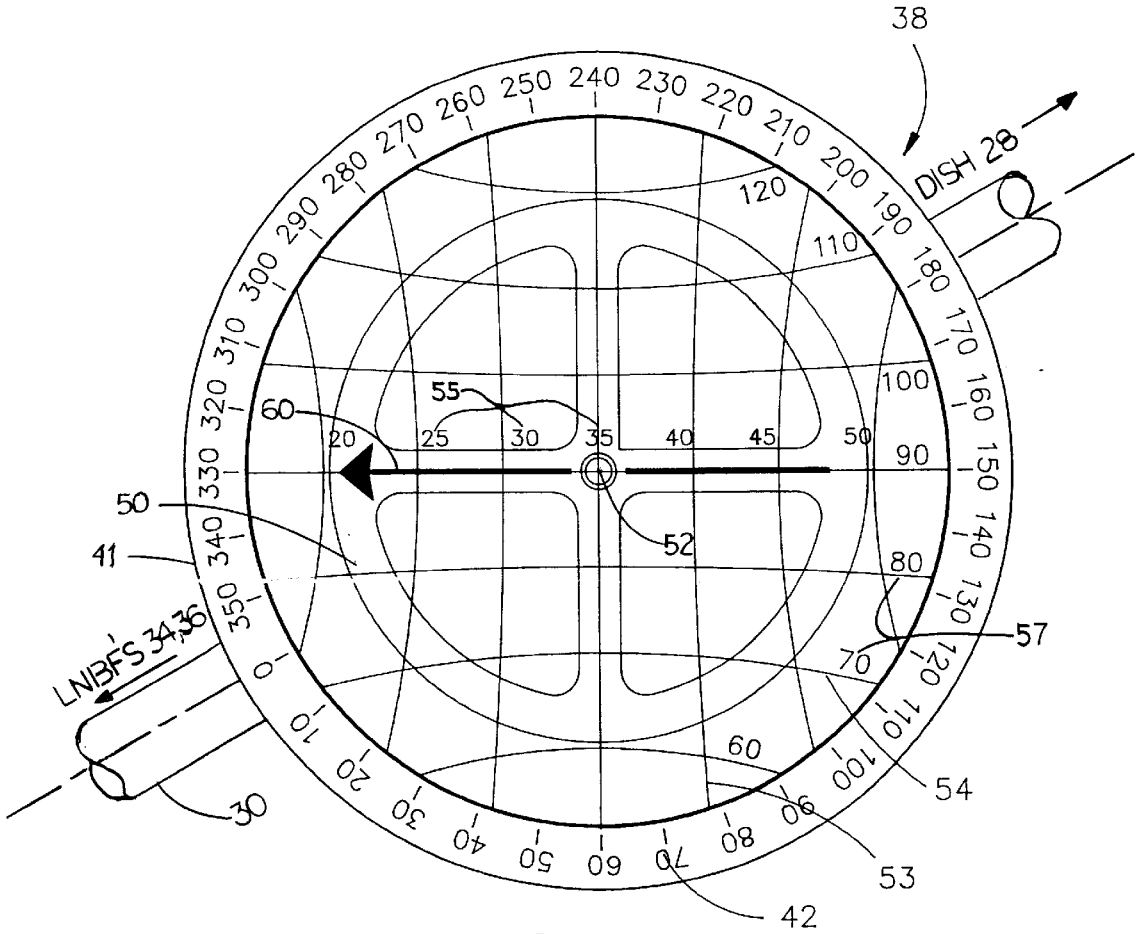
FIG. 4 is a top view of an embodiment of the invention.
Figure 5:
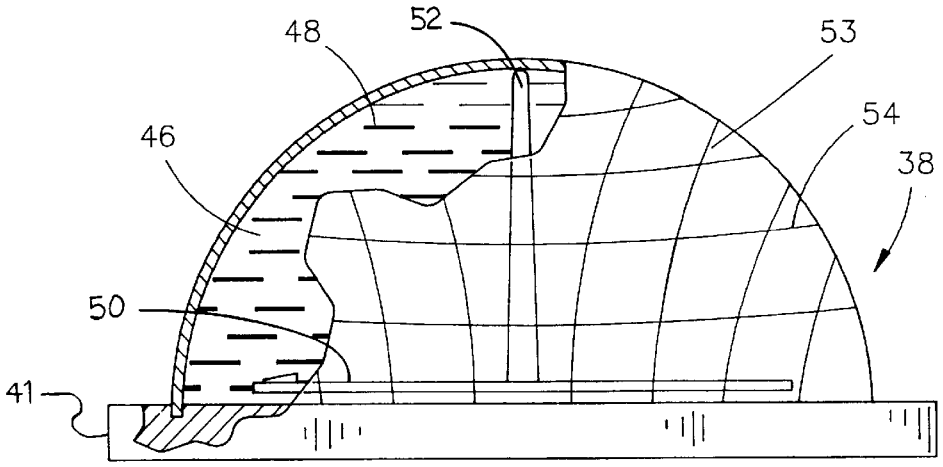
FIG. 5 is a side view of the embodiment of FIG. 4 with portions thereof cut away.
Figure 8:
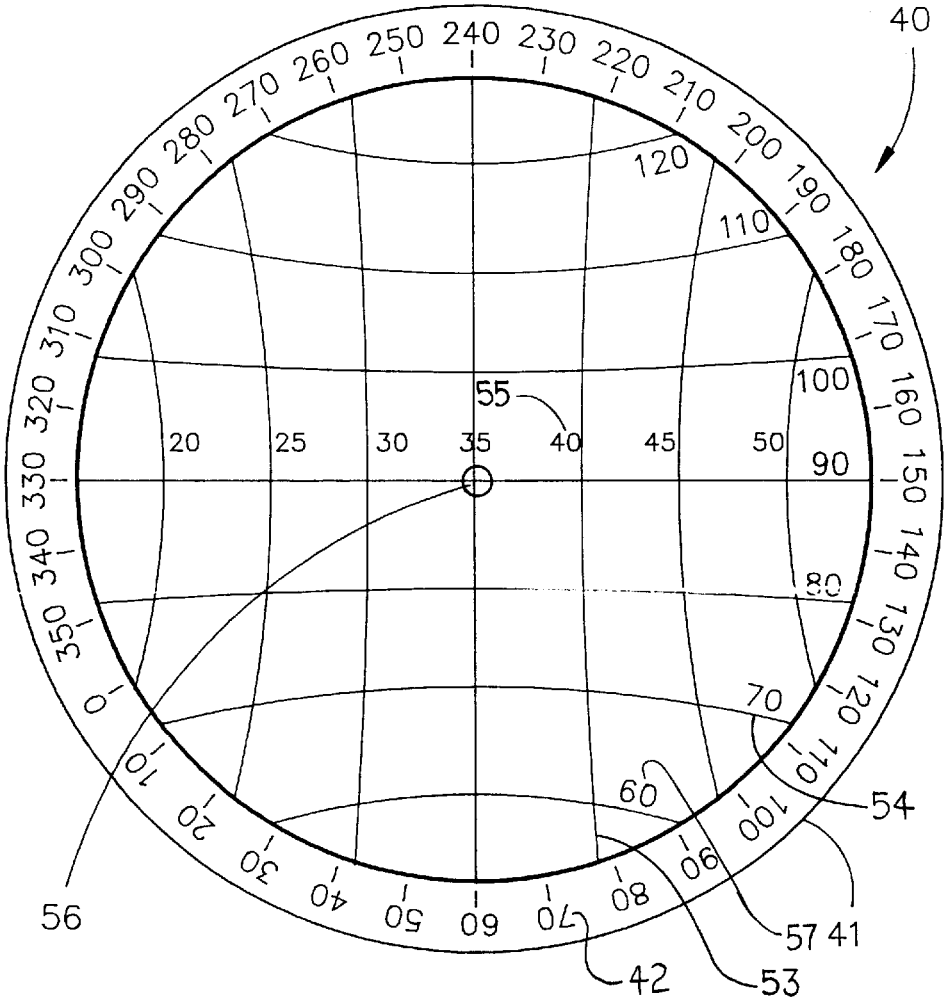
FIG. 8 is a top view of a further embodiment of the invention.
Figure 9:
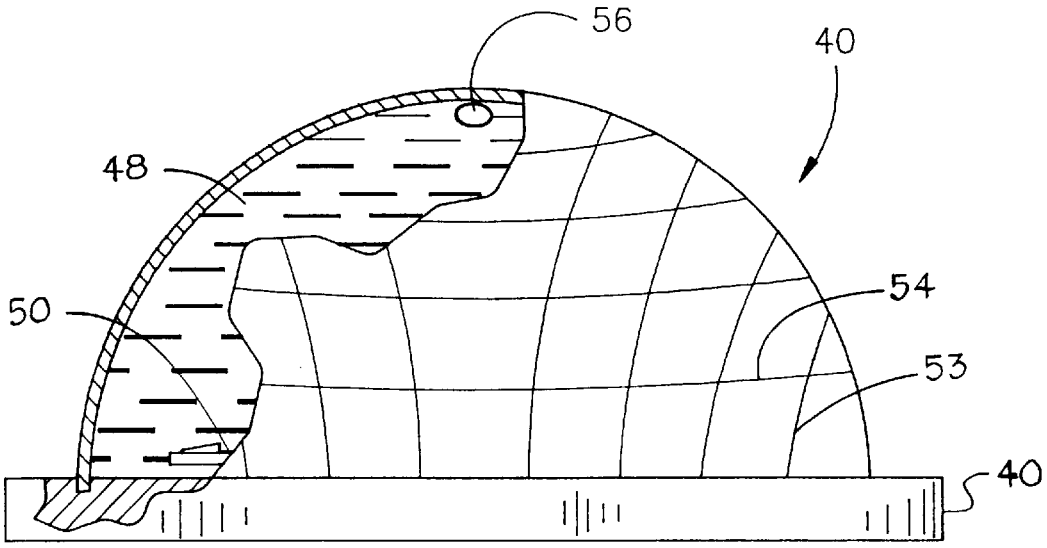
FIG. 9 is a side view of the embodiment of FIG. 8 with portions thereof cut away.

The numeral 38 refers to one embodiment of the satellite antenna alignment device (FIGS. 1, 4 and 5) while the numeral 40 refers to another embodiment of the invention (FIGS. 8, 9). Device 38 includes a base plate 41 having azimuth indicia 42 provided thereon. A semi-globular-shaped member or dome 44 is secured to and extends upwardly from base plate 41 to define a sealed compartment 46 (FIG. 5) which in this embodiment is filled with a liquid medium 48 such as is found in compasses used in vehicles. A floating plate 50 is positioned in compartment 46 and has an indicator 52 extending upwardly therefrom at its center. Dome 44 is transparent and is provided with curved elevation indicia 53 and curved skew angle indicia 54 thereon. The curved indicia 53, 54 are at right angles to one another. Each curved line 53 is marked with elevation degree numerals 55 that extend across a diameter of device 38. Each curved line 54 is marked with skew degree numerals 57 near the circumference of device 38.

Floating plate 50 includes an arrow 60 which always points north due to the magnetic character of plate 50. The azimuth indicia begin with 0° and progress in a counterclockwise direction to 360°. This counterclockwise direction is opposite to the normal clockwise progression on conventional compasses. Thus the point of arrow 60 always points to the exact azimuth setting of the device 38.

Device 40 is essentially the same construction as device 30 except that the indicator 52 has been replaced with a float member or air bubble 56 which always seeks the highest position within compartment 46 which is filled with a medium such as liquid or gas 48. Float member or air bubble 56 is visible through the dome 44.

Figure 6:
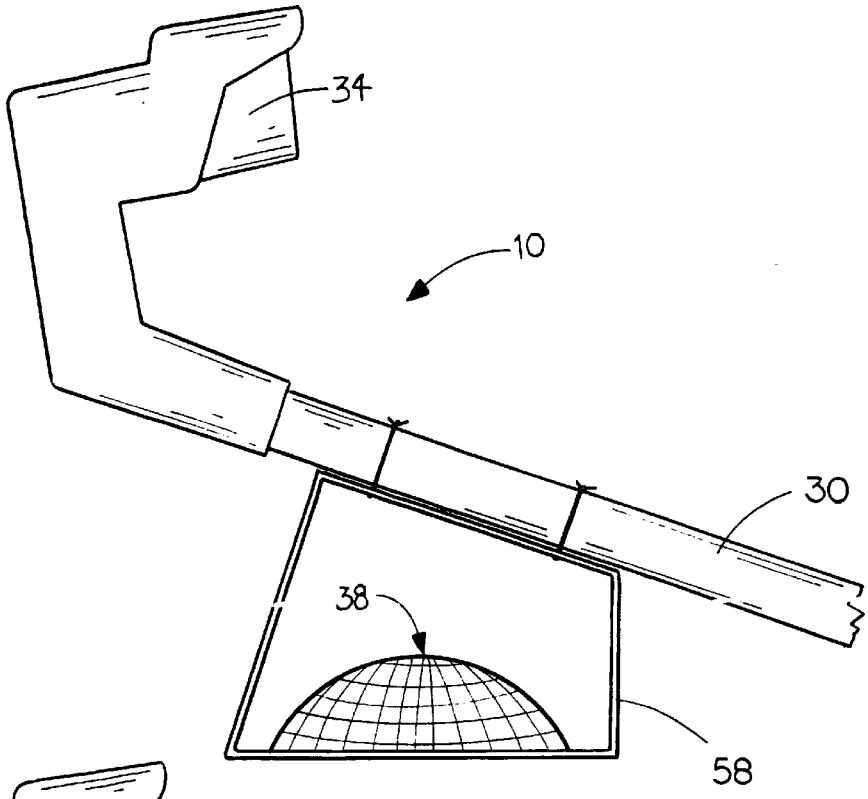
FIG. 6 is a side view illustrating the alignment device mounted on the support arm of a satellite antenna.
Figure 7:
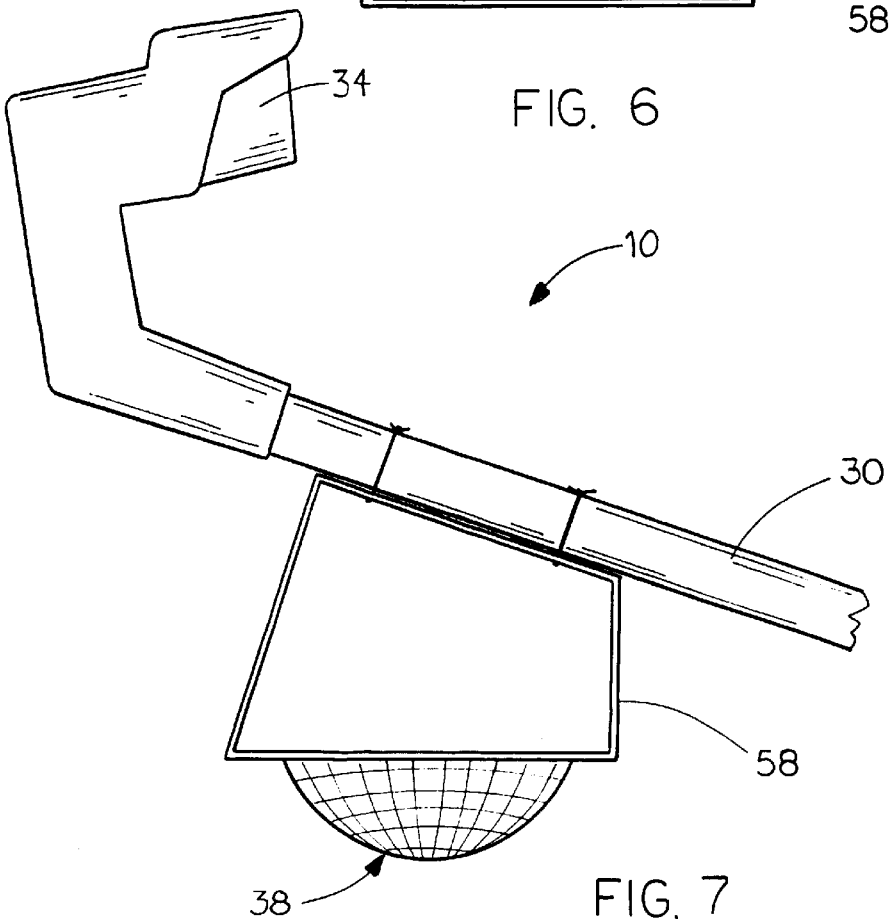
FIG. 7 is a side view similar to FIG. 6 except that the alignment device is shown in an inverted position.

The device 38 (or 40) may be mounted on the support arm 30, as seen in FIG. 3. The device 38 (or 40) may also be mounted on a support 58 which is secured to the arm 30, as seen in FIG. 6. If the device is mounted as seen in FIG. 7, only the device 38 will function properly, since the floating plate 50 and indicator will function in an inverted position. In either case the devices 38, 40 are mounted to the arm 30 with the azimuth indicia representing 180° pointing along arm 30 towards the satellite dish 28 (see FIG. 4).

For example, if the antenna is being used in zip code 68124, information provided by the manufacturer of the satellite antenna would indicate that the antenna should be directed along azimuth 201°, elevated to 38° and skewed to 110°. First, the installer will place a mark on the exterior surface of the dome 44 at the intersection of the elevation angle of 38° and the skew angle of 110°. The alignment device 38 is then secured to the support arm 30 of the antenna by any convenient means, such as seen in FIG. 3 or as seen in FIG. 6 with the 180° azimuth indicia 42 pointing toward the dish 28. Bolts are loosened so that antenna 10 may be rotated about azimuth axis 18 until arrow 60 points to the indicia for azimuth 201°. Those bolts are then tightened and bolts on the mounting bracket would then be loosened so that the support arm 30 could be elevated and skewed until the upper end of the indicator 52 (if device 38 is being used) is directly positioned beneath the marked intersection of the 38° elevation and the 110° skew. If device 40 is being used, the support arm 30 is elevated and skewed until the float member or air bubble is directly positioned beneath the marked intersection of the 38° elevation and the 110° skew. Bolts on the mounting bracket would then be tightened to maintain the antenna and support arm in that position. The alignment device is then removed for subsequent use.

Thus it can be seen that a novel antenna alignment device has been provided which enables a satellite antenna to be quickly and easily adjusted for elevation and skew angles without the need for having the top portion of the mast in a perfectly vertically disposed position. The antenna devices of this invention may be used in conjunction with those satellite antennas adapted to receive signals from two or more satellites.

Thus it can been seen that the invention accomplishes at least all of its stated objectives.

What is claimed is:

1. In combination:

a satellite antenna comprising a mast assembly, a dish mounting bracket secured to said mast assembly, a dish mounted on said mounting bracket for movement therewith, said mounting bracket including means for adjusting the elevation and skew of said dish, a support arm secured to said mounting bracket for movement with said mounting bracket and sad dish, and at least a pair of amplifiers mounted on said support arm;

a satellite antenna alignment device adapted to be removably positioned adjacent said support arm;

said satellite antenna alignment device including means for indicating the elevation and skew of the dish;

said alignment device having a base plate, said base plate having upper and lower ends, said upper and lower ends being removably positioned adjacent said support arm;

a transparent, hollow, semi-globular shaped member positioned on said base plate to define a sealed compartment therebetween;

said sealed compartment being filled with one of a gas or liquid medium;

said semi-globular shared member having indicia thereon which indicates elevation and skew angles; and an indicator movably positioned within said sealed compartment for indicating the elevation and skew of the dish.

2. The combination of claim 1 wherein said indicator comprises an air bubble.

3. The combination of claim 1 wherein said indicator comprises a float member.

4. The combination of claim 1 wherein said indicator comprises a floating plate having an indicator needle extending upwardly therefrom.

5. In combination:

a satellite antenna comprising a mast assembly, a dish mounting bracket secured to said mast assembly, a dish mounted on said mounting bracket for movement therewith, said mounting bracket including means for at least adjusting the elevation and skew of said dish, a support arm secured to said mounting bracket for movement with said mounting bracket and said dish, an amplifier mounted on said support arm;

a satellite antenna alignment device adapted to be removably positioned adjacent said support arm;

said satellite antenna alignment device including means for indicating the elevation and skew of the dish;

said alignment device having a base plate, said base plate having upper and lower ends, said base plate being removably positioned adjacent said support arm;

a transparent, hollow, semi-globular shaped member positioned on said base plate to define a sealed compartment therebetween;

said sealed compartment being filled with one of a gas or liquid medium;

said semi-globular shaped member having indicia thereon which indicates elevation and skew angles; and an indicator movable positioned within said sealed compartment for indicating the elevation and skew of the dish.

6. The combination of claim 5 wherein said indicator comprises an air bubble.

7. The combination of claim 5 wherein said indicator comprises a float member.

8. The combination of claim 5 wherein said indicator comprises a floating plate having an indicator needle extending upwardly therefrom.

9. In combination with a satellite antenna comprising a mast assembly, a dish mounting bracket secured to said mast assembly, a dish mounted on said mounting bracket for movement therewith, said mounting bracket including means for adjusting the elevation and skew of said dish, a support arm secured to said mounting bracket for movement with said mounting bracket and said dish, at least one amplifier mounted on said support arm, comprising:

a satellite antenna alignment device adapted to be removably positioned adjacent said support arm;

said satellite antenna alignment device including means for indicating the elevation and skew of the dish;

said satellite antenna alignment device having a base plate, said base plate having upper and lower ends, said base, plate being removably positioned adjacent said support arm;

a transparent, hollow, semi-globular shaped member positioned an said base plate to define a sealed compartment therebetween;

said sealed compartment being filled with one of a gas or liquid medium;

said semi-globular shaped member having indicia thereon which indicates elevation and skew angles; and an indicator movably positioned within said sealed compartment for indicating the elevation and skew of the dish.

10. The combination of claim 8 wherein said indicator comprises an air bubble.

11. The combination of claim 9 wherein said indicator comprises a float member.

12. The combination of claim 9 wherein said indicator comprises a floating plate having an indicator needle extending upwardly therefrom.

13. In combination:

a satellite antenna comprising a mast assembly, a dish mounting bracket secured to said mast assembly, a dish mounted on said mounting bracket for movement therewith, said mounting bracket including means for adjusting at least the elevation and skew of said dish, at least one amplifier operatively secured to said dish;

a satellite antenna alignment device adapted to be removably positioned adjacent said dish;

said satellite antenna alignment device including means for indicating the elevation and skew of the dish;

said alignment device having a base plate, said base plate having upper and lower ends, said base plate being removably positioned adjacent said support arm;

a transparent, hollow, semi-globular shaped member positioned on said base plate to define a sealed compartment therebetween;

said sealed compartment being filled with one of a gas or liquid medium;

said semi-globular shaped member having indicia thereon which indicates elevation and skew angles; and an indicator movably positioned within said sealed compartment for indicating the elevation and skew of the dish.

14. The combination of claim 13 wherein indicator comprises an air bubble.

15. The combination of claim 13 wherein indicator comprises a float member.

16. The combination of claim 13 wherein indicator comprises a floating plate having an indicator needle extending upwardly therefore.

17. A satellite antenna alignment device for aligning a satellite dish antenna, comprising:

a base movable about an elevation axis and a skew axis;

a dome mounted on the base and combining therewith to form an enclosed compartment;

a plurality of elevation indicia on the dome indicating elevation lines corresponding to the elevation angle of the base;

a plurality of skew indicia on the dome indicating skew lines corresponding to the skew angle of the base, the skew lines intersecting with the elevation indicia lines;

a direction indicator within the dome adapted to maintain a constant orientation throughout movement of the base and dome, the direction indicator being movable within the dome in response to movement of the base about the elevation axis and the skew axis to an intersection point of the elevation and skew lines to indicate the skew angle and the elevation angle of the base with respect to the skew axis and the elevation axis, respectively.

18. A satellite antenna alignment device according to claim 17 wherein a fluid is within the enclosed compartment and the direction indicator is a bubble within the fluid.

19. A satellite antenna alignment device according to claim 17 wherein a fluid is within the enclosed compartment and the direction indicator is a float member floating on the fluid.

20. A satellite antenna alignment device according to claim 19 wherein said direction indicator has an elevation-scew member adapted to always point in a vertical direction.

21. A satellite antenna alignment device according to claim 20 wherein the direction indicator has an arrow adapted to always point south, and a plurality of azimuth indicia are on the dome or base, whereby the arrow will always point to the one of the azimuth indicia indicating the rotational azimuth position of the base with respect to an azimuth axis.

22. A satellite antenna alignment device according to claim 21 wherein the plurality of azimuth indicia are in a circular array surrounding the arrow, the azimuth indicia commencing with an initial indicia representing zero degrees and progressing in a counterclockwise direction around the arrow to a concluding indicia representing three hundred and sixty degrees.

23. A satellite antenna alignment device according to claim 22 and further comprising a satellite dish and an elongated support arm extending from the satellite dish, the base being attached to the support arm with the azimuth indicia representing 180° being aligned with the longitudinal axis of the support arm and pointing toward the satellite dish.

* * * * *